US011117372B2

(12) United States Patent
Asami et al.

(10) Patent No.: US 11,117,372 B2
(45) Date of Patent: Sep. 14, 2021

(54) EJECTING HEAD

(71) Applicant: SEIKO EPSON CORPORATION, Tokyo (JP)

(72) Inventors: Masahiro Asami, Shiojiri (JP); Akira Miyagishi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/887,799

(22) Filed: May 29, 2020

(65) Prior Publication Data

US 2020/0376837 A1 Dec. 3, 2020

(30) Foreign Application Priority Data

May 30, 2019 (JP) ..... JP2019-101044

(51) Int. Cl.
*B41J 2/14* (2006.01)

(52) U.S. Cl.
CPC ..... *B41J 2/14* (2013.01)

(58) Field of Classification Search
CPC .. B41J 2/1404; B41J 2/14; B41J 2002/14419; B41J 2002/14411; B41J 2202/12; B41J 2202/11; B41J 2/14233; B41J 2002/14241; B41J 2002/14475; B41J 2/1433; B41J 2/14201; B41J 2002/14193
See application file for complete search history.

(56) References Cited

U.S. PATENT DOCUMENTS

| | | | |
|---|---|---|---|
| 2007/0146437 | A1 | 6/2007 | Murakami et al. |
| 2007/0200896 | A1 | 8/2007 | Ozawa et al. |
| 2014/0125737 | A1 | 5/2014 | Tomizawa et al. |
| 2015/0290934 | A1 | 10/2015 | Muraoka et al. |
| 2017/0259563 | A1* | 9/2017 | Ozawa ..... B41J 2/14233 |
| 2017/0282555 | A1 | 10/2017 | Meutter et al. |
| 2018/0339511 | A1 | 11/2018 | Takei |

FOREIGN PATENT DOCUMENTS

| | | |
|---|---|---|
| JP | 2008-137341 | 6/2008 |
| JP | 2014-111358 | 6/2014 |

OTHER PUBLICATIONS

IP.com searchq (Year: 2021).*

* cited by examiner

*Primary Examiner* — Lisa Solomon
(74) *Attorney, Agent, or Firm* — Workman Nydegger

(57) ABSTRACT

The nozzle is provided so that a difference between a maximum value and a minimum value of distances, at the second position, between the center portion and edge portions of the nozzle is smaller than a difference between a maximum value and a minimum value of distances, at the first position, between the center portion and edge portions of the nozzle.

9 Claims, 7 Drawing Sheets

EJECTING HEAD

The present application is based on, and claims priority from JP Application Serial Number 2019-101044, filed May 30, 2019, the disclosure of which is hereby incorporated by reference herein in its entirety.

BACKGROUND

1. Technical Field

The present disclosure relates to an ejecting head.

2. Related Art

Ejecting heads are provided in liquid ejecting apparatuses such as ink jet printers. Nozzles that eject a liquid, such as ink, as droplets are provided in the ejecting head. The droplet ejected from the nozzle is constituted of a spherical main droplet portion formed at the front end of the droplet, and a liquid column portion that succeeds the main droplet portion. The liquid column portion is separated from the main droplet portion, and sub droplet portions called satellites are formed by the liquid column portion itself splitting into satellites. In order to improve the image quality, it is desirable that the number of satellites is small. Accordingly, in a technique described in JP-A-2014-111358, protrusions that protrude towards the inner side of the nozzle is provided at an edge portion of the nozzle to facilitate separation between the droplet that is ejected and the liquid that is remaining, so that the liquid column portion is shortened and the occurrence of the satellites is suppressed.

However, when protrusions are provided in the edge portion of the nozzle, a shape of a meniscus formed in the nozzle becomes deformed, which may cause the vibration of the meniscus become unstable compared to when the nozzle is circular. Accordingly, when the ejecting head is driven continuously, due to the generation of unstable vibration in the meniscus created by the previous drive, deviation from the ejection direction, splitting of the droplet, change in the ejection amount, and the like may occur when the droplet is ejected by the next drive.

SUMMARY

According to a configuration of the present disclosure, an ejecting head is provided. The ejecting head includes an energy generating element that generates energy that ejects a liquid, an energy generating chamber that contains the energy generating element, and a nozzle that is in communication with the energy generating chamber and that ejects the liquid in an ejection direction with the energy generated by the energy generating element. Furthermore, when a first position is a specific position in the nozzle in the ejection direction, a second position is a specific position in the nozzle, which is downstream the first position in the ejection direction, a first direction is a specific direction intersecting the ejection direction, a second direction is a specific direction intersecting the ejection direction and the first direction, and a center portion is a position that corresponds to a center of the nozzle in the first direction and to that in the second direction at positions in the ejection direction including the first position and the second position, the nozzle is provided so that a difference between a maximum value and a minimum value of distances, at the second position, between the center portion and edge portions of the nozzle is smaller than a difference between a maximum value and a minimum value of distances, at the first position, between the center portion and edge portions of the nozzle.

DESCRIPTION OF EXEMPLARY EMBODIMENTS

First Exemplary Embodiment

Figure 1:
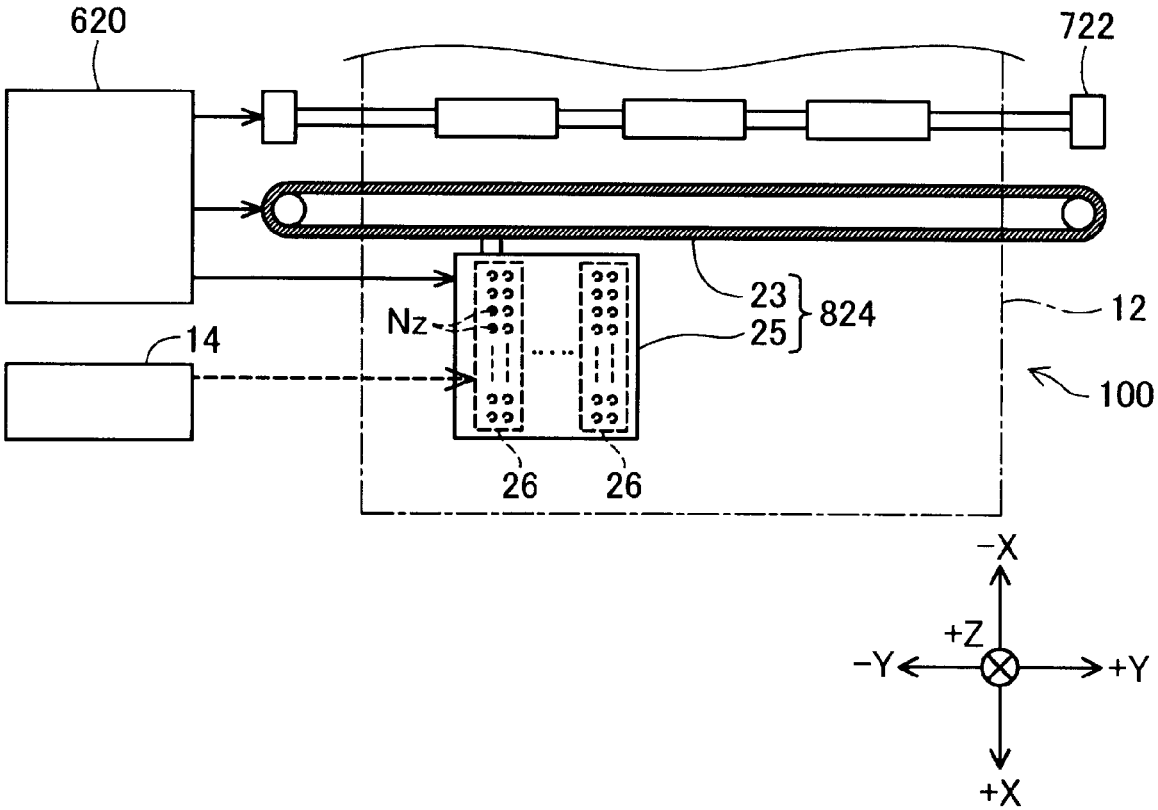
FIG. 1 is a schematic diagram illustrating a schematic configuration of a liquid ejecting apparatus including ejecting heads.

FIG. 1 is a schematic diagram illustrating a schematic configuration of a liquid ejecting apparatus 100 including ejecting heads 26 serving as a first exemplary embodiment of the present disclosure. The liquid ejecting apparatus 100 is an ink jet printer that performs printing by ejecting droplets of ink, which is an example of a liquid, on a medium 12. Other than printing paper, a subject to be printed of any material such as a resin film, fabric, and the like can be adopted as the medium 12. In each of the drawings from FIG. 1 and after, among the X direction, the Y direction, and the Z direction that are orthogonal to each other, the X direction is a nozzle row direction, the Z direction is a direction extending in an ejection direction of the ink from nozzles Nz, and the Y direction is a direction orthogonal to the X direction and the Z direction. The ink ejection direction may be parallel to the vertical direction or may be a direction that intersects the vertical direction. A main scanning direction that extends in a transport direction of the ejecting heads 26 is the Y direction, and a sub scanning direction that is a direction in which the medium 12 is sent is the X direction. In the following description, for the sake of description, the main scanning direction will be referred to as a printing direction, as appropriate.

In the present exemplary embodiment, the +Z direction in the Z direction is also referred to as an ejection direction Z of the ink. Furthermore, the X direction that is a specific direction that intersects the ejection direction Z is also referred to as a first direction X. Furthermore, the Y direction that is a specific direction that intersects the ejection direction Z and the first direction X is also referred to as a second direction Y. Hereinafter, when specifying an orientation of a direction, the positive direction is denoted with "+", the negative direction is denoted with "−", and when denoting the direction, both the positive and the negative signs will be denoted. Note that while the liquid ejecting apparatus 100 of the present exemplary embodiment is a serial printer in which the ejecting heads 26 are transported in the Y direction, the liquid ejecting apparatus 100 may be a line printer in which the ejecting heads 26 are fixed and the nozzles Nz are arranged across the entire width of the medium 12.

The liquid ejecting apparatus 100 includes a liquid container 14, a transport mechanism 722 that sends out the medium 12, a control unit 620, a head moving mechanism 824, and the ejecting heads 26. The liquid container 14 separately stores various types of ink that are ejected from the ejecting heads 26. A bag-shaped liquid pack formed of flexible film, a cartridge detachable from the liquid ejecting apparatus 100, or the like can be used as the liquid container 14.

The ejecting head 26 each include a plurality of nozzles Nz that eject the liquid. The nozzles Nz constitute nozzle rows that are each arranged in the X direction. In the present exemplary embodiment, two nozzle rows are used to eject a single type of liquid. Each nozzle Nz includes, at a position opposing the medium 12, ejection ports that eject the liquid.

The control unit 620 includes processing circuits such as a single or a plurality of central processing units (CPUs) and a field programmable gate array (FPGA), and a memory circuit such as a semiconductor memory. The control unit 620 controls the transport mechanism 722, the head moving mechanism 824, and the ejecting heads 26 in an integrated manner. The transport mechanism 722 is operated under the control of the control unit 620, and transports the medium 12 in the X direction. In other words, the transport mechanism 722 is a mechanism that moves the medium 12 relative to the ejecting heads 26.

The head moving mechanism 824 includes a transport belt 23 stretched in the X direction and across the printing area of the medium 12, and a carriage 25 that accommodates the ejecting heads 26 and that fixes the ejecting heads 26 to the transport belt 23. The head moving mechanism 824 is operated under the control of the control unit 620 and, together with the carriage 25, reciprocates the ejecting heads 26 in the main scanning direction. When the carriage 25 is reciprocated, the carriage 25 is guided by a guide rail (not shown). Note that the liquid container 14 may be mounted in the carriage 25 together with the ejecting heads 26.

The ejecting head 26 includes the nozzle rows that are rows of nozzles Nz arranged in the sub scanning direction. The ejecting heads 26 are provided for each color of the liquid stored in the liquid container 14 and eject the liquid supplied from the liquid container 14 through the plurality of nozzles Nz towards the medium 12 under the control of the control unit 620. A desired image and the like are printed on the medium 12 by ejection of the liquid through the nozzles Nz while the ejecting heads 26 are reciprocated. An arrow depicted by a broken line in FIG. 1 schematically depicts the movement of the ink between the liquid container 14 and the ejecting head 26.

Figure 2:
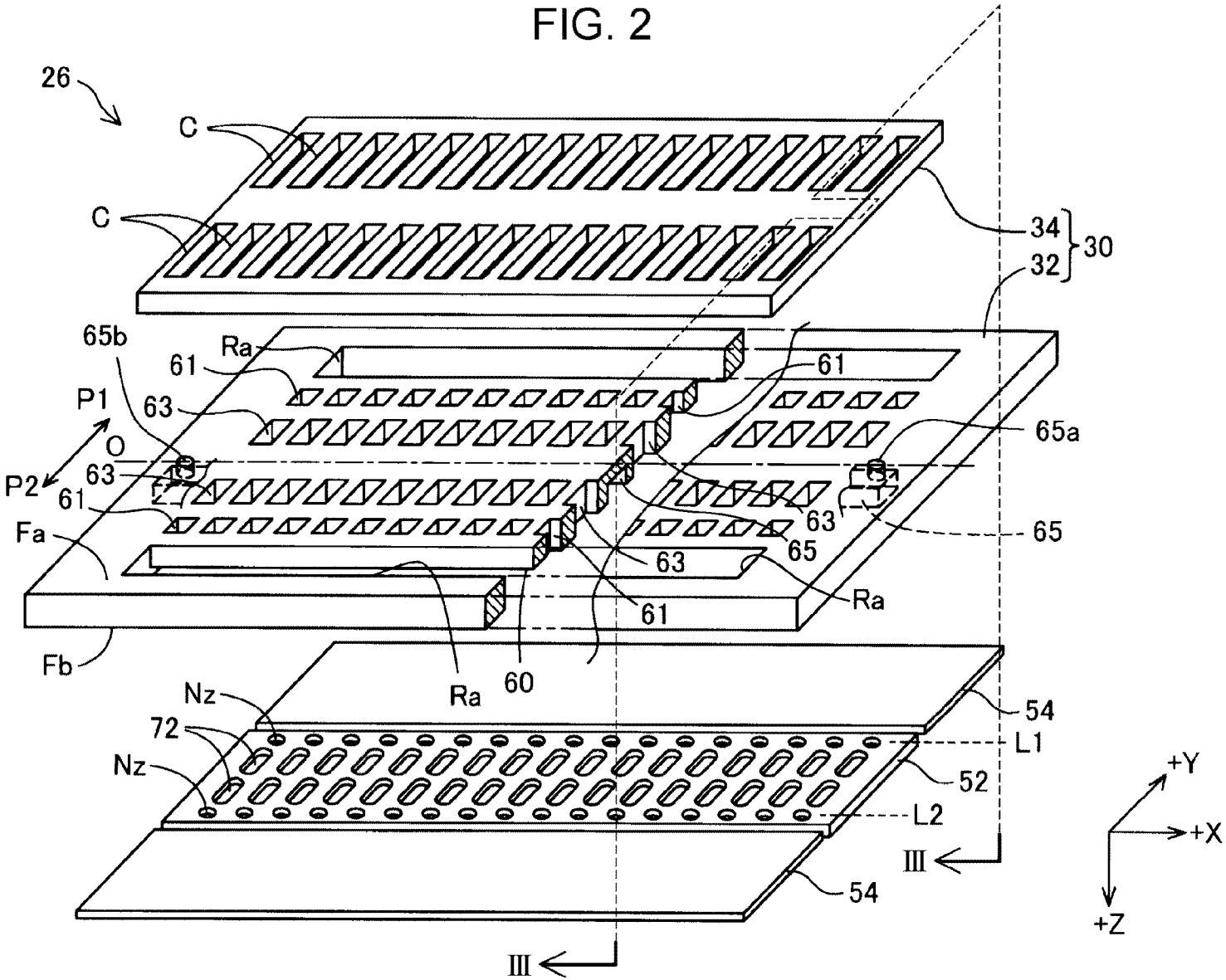
FIG. 2 is a diagram of the main head components of the ejecting head illustrated in exploded view.
Figure 3:
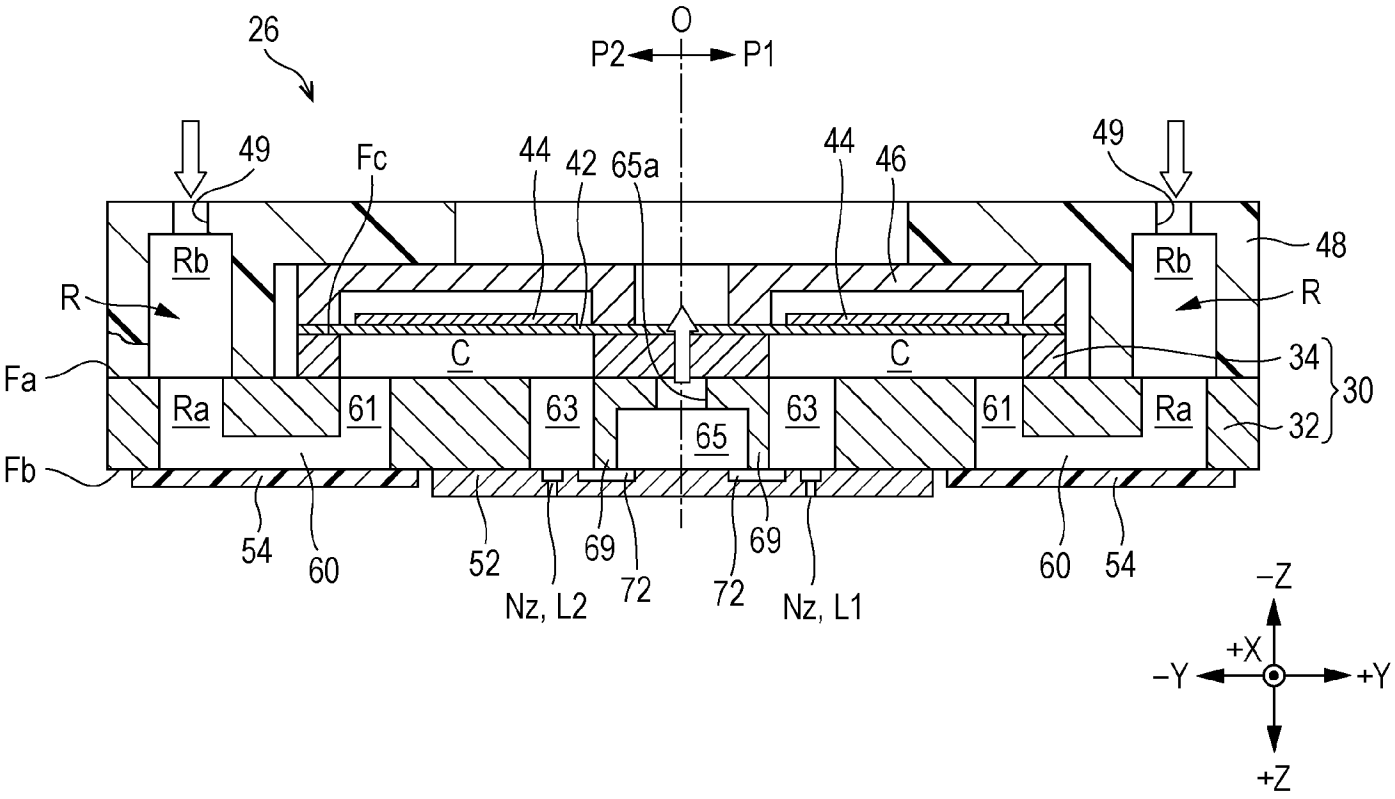
FIG. 3 is a cross-sectional view of the ejecting head.

FIG. 2 is a diagram of the main head components of the ejecting head 26 illustrated in exploded view. FIG. 3 is a cross-sectional view of the ejecting head 26 taken along line III-III in FIG. 2. The ejecting head 26 includes energy generating elements 44, energy generating chambers C, and the nozzles Nz. The energy generating elements 44 in the present exemplary embodiment are piezoelectric elements and generate energy that ejects the liquid. The energy generating chamber C contains the energy generating element 44. The nozzle Nz is in communication with the energy generating chamber C and ejects the liquid in the ejection direction Z with the energy generated by the energy generating element 44. Not limited to a piezoelectric element, the energy generating element 44 may be an electrothermal conversion element that ejects the liquid by film boiling the liquid inside the nozzle Nz by generating thermal energy.

As illustrated in FIGS. 2 and 3, the ejecting head 26 including a first nozzle row L1 and a second nozzle row L2 is a layered body in which the head components are layered. Thicknesses of the constituent members illustrated in the drawing do not depict the actual thicknesses of the components. In FIG. 2, for the sake of illustration, some of the portions of a first flow path substrate 32 that is a component are omitted.

As illustrated in FIG. 3, the ejecting head 26 includes components related to the nozzles Nz of the first nozzle row L1 and components related to the nozzles Nz of the second nozzle row L2 in a plane symmetric manner with a center plane O interposed in between. In other words, in the ejecting head 26, a first portion P1 on the +X direction side and a second portion P2 on the +X direction side with the center plane O interposed in between have a common configuration. The nozzles Nz of the first nozzle row L1 belong to the first portion P1, and the nozzles Nz of the second nozzle row L2 belong to the second portion P2. The center plane O is an interface between the first portion P1 and the second portion P2.

The ejecting head 26 includes, as the main constituent members, a flow path forming portion 30 that is involved in forming flow paths in the ejecting head 26, and a housing portion 48 that is involved in supplying/ejecting the ink. The flow path forming portion 30 is configured of layers of the first flow path substrate 32 and a second flow path substrate 34. The two substrates, namely, the first flow path substrate 32 and the second flow path substrate 34, are plates long in the X direction. The second flow path substrate 34 is fixed to an upper face Fa of the first flow path substrate 32 in the −Z direction with an adhesive agent.

A vibrating portion 42, the plurality of energy generating elements 44, protective members 46, and a housing portion 48 are disposed on an upper face Fc side of the second flow path substrate 34. The vibrating portion 42 is a thin paper-like member long in the X direction and is disposed from the first portion P1 to the second portion P2. The protective members 46 are members long in the X direction and are disposed from the first portion P1 to the second portion P2. The protective members 46 each forming a recessed space on the upper face side of the vibrating portion 42 cover the vibrating portion 42. The housing portion 48 is a member long in the X direction. The protective members 46 are provided on both sides of the center plane O. The protective members 46 may be held between the housing portion 48 and the second flow path substrate 34. Other than the above, a nozzle plate 52 and vibration absorbing members 54 are disposed on an underface Fb of the first flow path substrate 32 in the Z direction. The nozzle plate 52 and the vibration absorbing members 54 are both plates long in the X direction. The nozzle plate 52 straddling the center plane O is disposed from the first portion P1 to the second portion P2. The vibration absorbing members 54 are each individually disposed in the first portion P1 and the second portion P2. Each of the above elements is adhered to the underface Fb of the first flow path substrate 32 with an adhesive agent.

As illustrated in FIG. 2, the nozzle plate 52 includes the nozzles Nz of the first portion P1 and the nozzles Nz of the second portion P2 in a row, and two rows of second individual flow paths 72 between the first nozzle row L1 in which the nozzles Nz of the first portion P1 are arranged, and the second nozzle row L2 in which the nozzles Nz of the second portion P2 are arranged. Note that first individual flow paths 61 will be described later. As illustrated in FIG. 3, the second individual flow paths 72 are recessed grooves formed in the surface of the nozzle plate 52. The second individual flow paths 72 may not be recessed grooves formed in the surface of the nozzle plate 52 but can be recessed grooves formed in the surface of the first flow path substrate 32. The second individual flow paths 72 on the +Y direction side are formed next to the nozzles Nz of the first nozzle row L1, and the second individual flow paths 72 on the −Y direction side is formed next to the nozzles Nz of the second nozzle row L2. The nozzle plate 52 is formed of a silicon single crystal substrate in which a semiconductor manufacturing technique, such as a processing technique such as dry etching or wet etching, for example has been used so as to have the nozzles Nz and the second individual flow paths 72 therein. In the present exemplary embodiment, a shape of a portion of each nozzle Nz in the nozzle plate 52 open towards the −Z direction side and a shape of a portion of each nozzle Nz in the nozzle plate 52 open towards the +Z direction side are different from each other. Details of the shape of the nozzle Nz will be described later. Hereinafter, the side of the nozzle Nz open in the +Z direction is referred to as a front end side or downstream of the nozzle Nz. Furthermore, the side of the nozzle Nz open in the −Z direction is referred to as a rear end side or upstream of the nozzle Nz.

As illustrated in FIG. 3, the vibration absorbing members 54 forms a bottom surface of the ejecting head 26 together with the nozzle plate 52. By being adhered to the underface Fb of the first flow path substrate 32, the vibration absorbing member 54 forms bottom surfaces of an ink flow-in chamber Ra, a first common flow path 60, and first individual flow paths 61. The vibration absorbing member 54 is configured of a flexible film that absorbs the pressure fluctuations in the ink flow-in chambers Ra, and a substrate that supports the film, for example.

By adhering the nozzle plate 52 and the vibration absorbing members 54 to the first flow path substrate 32, the ink flow-in chamber Ra, the first common flow path 60, the first individual flow paths 61, and communication passages 63 are formed in each of the first portion P1 and the second portion P2, and a second common flow path 65 that is common to the first portion P1 and the second portion P2 is formed. As illustrated in FIG. 2, the ink flow-in chambers Ra are each formed in the first flow path substrate 32 as a through-hole opening long in the X direction. The first individual flow paths 61 and the communication passages 63 are formed in the first flow path substrate 32 as through holes. The first common flow path 60 is formed in the underface Fb of the first flow path substrate 32 as a recessed portion extending from the ink flow-in chamber Ra towards the center plane O. As illustrated in FIG. 3, the ink flow-in chambers Ra, the first common flow paths 60, and the first individual flow paths 61 are formed by adhering the vibration absorbing members 54 to the underface Fb of the first flow path substrate 32. The ink flow-in chambers Ra, the first common flow paths 60, and the first individual flow paths 61 are involved in supplying ink to the nozzles Nz.

As illustrated in FIG. 2, the second common flow path 65 is formed in the underface Fb of the first flow path substrate 32 as a recessed groove long in the X direction. As illustrated in FIG. 3, the communication passages 63 and the second common flow path 65 are formed by adhering the nozzle plate 52 to the underface Fb of the first flow path substrate 32. The nozzle plate 52 includes the nozzles Nz of the first nozzle row L1 and the second nozzle row L2, and the second individual flow paths 72. Each of the nozzles Nz is provided at a position that overlaps the corresponding communication passage 63 in plan view in the Z direction. The second individual flow paths 72 are provided for each nozzle row and at positions overlapping partitioning wall portions 69 that each partition the communication passages 63 and the second common flow path 65, when in plan view in the Z direction. By adhering the nozzle plate 52 to the underface Fb of the first flow path substrate 32, the second individual flow paths 72 become ink flow paths that straddle the partitioning wall portions 69 and that communicate the communication passages 63 and the second common flow path 65 for each of the nozzles Nz. The second common flow path 65 is involved in the discharge of the ink from the communication passages 63 by receiving an inflow of the ink from the communication passage 63 of each nozzle Nz through the corresponding second individual flow path 72.

As illustrated in FIG. 2, the second common flow path 65 is a recessed groove that is longer than the rows of the nozzles Nz in the first nozzle row L1 and the second nozzle row L2, and includes circulation ports 65*a* and 65*b* at both ends of the groove. The circulation ports 65*a* and 65*b* are through holes that penetrate through a bottom wall of the second common flow path 65, in other words, through the first flow path substrate 32, and are coupled to a circulation mechanism (not shown) that circulates the ink through the ejecting head 26. The circulation ports 65*a* and 65*b* are coupled to the circulation mechanism through a flow path provided in the housing portion 48 at a position different from the cross section taken along line III-III. After flowing into the communication passages 63, the ink passes through the second individual flow paths 72, enters the second common flow path 65, and is discharged from the ejecting head 26 through the circulation ports 65*a* and 65*b* of the second common flow path 65. The discharged ink flows again into an ink introduction opening 49 with the circulation mechanism.

The second flow path substrate 34 adhered to the upper face Fa of the first flow path substrate 32 forms energy generating chambers C in each of the first portion P1 and the second portion P2. The energy generating chamber C is a through hole extending in the Y direction and is formed for each of the nozzles Nz of the first nozzle row L1 and the second nozzle row L2. The lower end side of the through hole of the energy generating chamber C in the +Z direction is in communication with the first individual flow path 61 and the communication passage 63 of the first flow path substrate 32. Note that in the present specification, when the energy generating chamber C and the communication passage 63 are described without any distinction, the energy generating chamber C and the communication passage 63 may be collectively referred to as the energy generating chamber C. The energy generating chamber C is also referred to as a pressure chamber. The upper end sides of the through holes in the energy generating chambers C in the −Z direction are closed by the vibrating portion 42 held between the second flow path substrate 34 and the protective members 46. The energy generating chambers C may not be formed by the through holes provided in the second flow path substrate 34 and the vibrating portion 42 but may be formed by integrally forming the second flow path substrate 34 and the vibrating portion 42. The energy generating chamber C in which the upper end side is closed functions as a cavity of each of the nozzles Nz of the first nozzle row L1 and the second nozzle row L2. The first flow path substrate 32 and the second flow path substrate 34 described above are, similar to the nozzle plate 52, formed of a silicon single crystal substrate in which a semiconductor manufacturing technique described above has been used.

The vibrating portion 42 held between the second flow path substrate 34 and the protective members 46 is a plate-shaped member that is capable of elastically vibrating. The energy generating element 44 is provided on the upper side of the vibrating portion 42 and for each energy generating chamber C. In other words, a single energy generating element 44 is provided for a single nozzle Nz. The energy generating element 44 in the present exemplary embodiment is a piezoelectric element that is deformed by a drive signal from the control unit 620. The vibration of the energy generating element 44 causes a pressure change in the ink that has been supplied to the energy generating chamber C. Such a pressure change reaches the nozzle Nz through the communication passage 63.

The protective members 46 are each a plate-shaped member that protects the energy generating elements 44, and are layered on the first flow path substrate 32 while interposing the vibrating portion 42 with the second flow path substrate 34. Similar to the first flow path substrate 32 and the second flow path substrate 34, the protective members 46 can be formed of a silicon single crystal substrate in which the semiconductor manufacturing technique described above has been used, or may be formed of another material.

The housing portion 48 is a member that covers the upper face side of the ejecting heads 26 and is involved in protecting the entire head, storing the ink supplied to the energy generating chambers C of the nozzles Nz, and supplying the ink from the liquid container 14. More specifically, the housing portion 48 includes upstream ink flow-in chambers Rb that overlaps the ink flow-in chambers Ra of the first flow path substrate 32 in the Z direction. Ink storage chambers R are formed with the upstream ink flow-in chambers Rb and the ink flow-in chambers Ra of the first flow path substrate 32. The ink storage chambers R are also referred to as reservoirs. The ink is supplied to the upstream ink flow-in chambers Rb through the ink introduction openings 49 formed in the ceilings of the upstream ink flow-in chambers Rb. The housing portion 48 is formed by injection molding an appropriate resin material.

Figure 4:
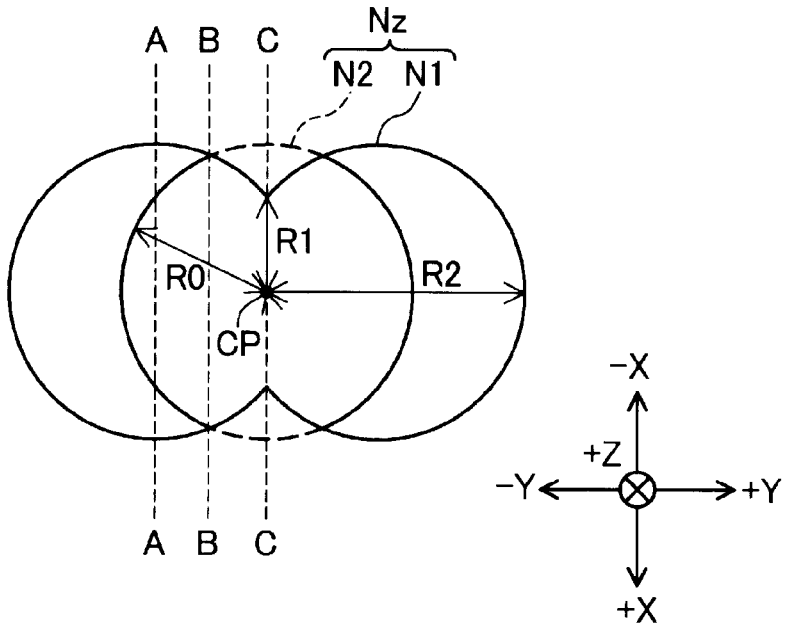
FIG. 4 is a diagram illustrating a shape of a nozzle.
Figure 5:
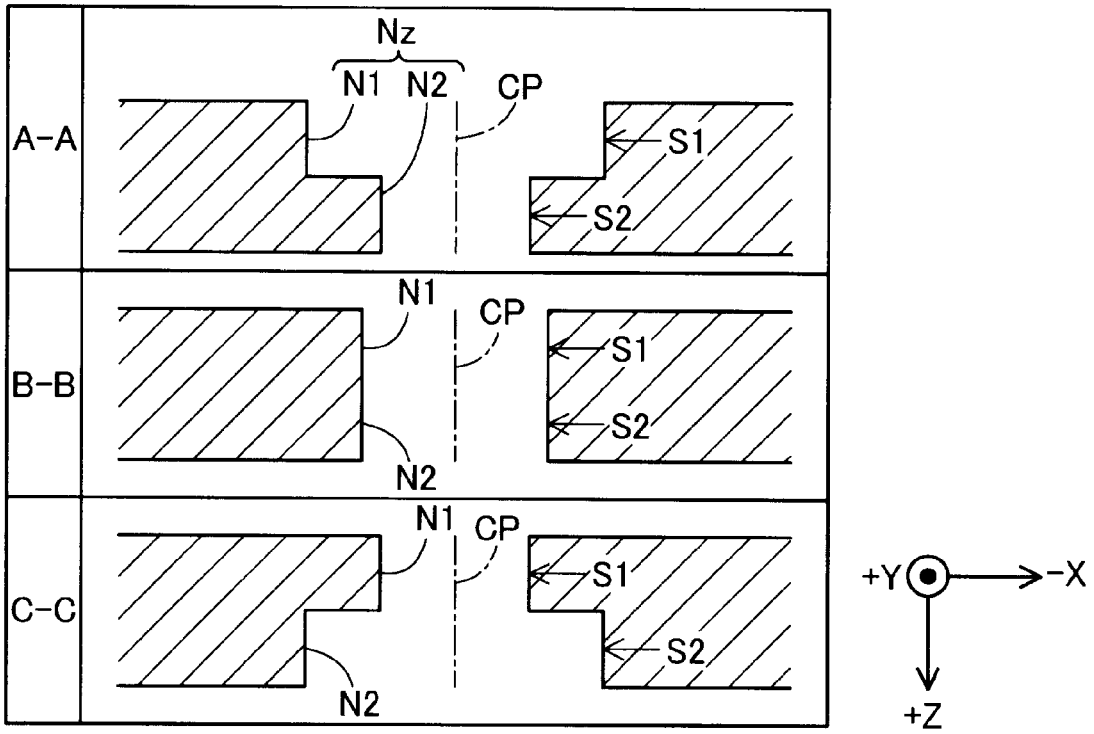
FIG. 5 is a diagram illustrating cross-sectional structures of various portions of the nozzle.

FIG. 4 is a diagram illustrating a shape of the nozzle Nz according to the first exemplary embodiment. FIG. 5 is a diagram illustrating a cross-sectional structure of various portions of the nozzle Nz. FIG. 4 illustrates a shape of the nozzle Nz when viewed from the −Z direction towards the +Z direction. FIG. 5 schematically illustrates shapes of the cross sections taken along line A-A, line B-B, and line C-C in FIG. 4.

The nozzle Nz includes a first nozzle portion N1 and a second nozzle portion N2. The first nozzle portion N1 is located on the rear end side of the nozzle Nz. The second nozzle portion N2 is located on the front end side of the nozzle Nz. In other words, the second nozzle portion N2 is disposed downstream of the first nozzle portion N1 in the ejection direction Z, and the first nozzle portion N1 is disposed upstream of the second nozzle portion N2 in the ejection direction Z. In the present exemplary embodiment, the maximum width of the second nozzle portion N2 is smaller than the maximum width of the first nozzle portion N1. Furthermore, the maximum width of the first nozzle portion N1 is larger than one time and smaller than twice the maximum width of the second nozzle portion N2.

Note that as illustrated in FIG. 5, a specific position in the nozzle Nz in the ejection direction Z is referred to as a first position S1, and a specific position in the nozzle Nz downstream the first position in the ejection direction Z is referred to as a second position S2. The first position S1 corresponds to the position where the first nozzle portion N1 is provided. The second position S2 corresponds to the position where the second nozzle portion N2 is provided. Furthermore, as illustrated in FIGS. 4 and 5, a center portion CP is a position in the ejection direction Z that corresponds to a center of the nozzle Nz in the first direction X and that in the second direction Y at positions including the first position S1 and the second position S2. In other words, a distance from the center portion CP to one end of the nozzle Nz in the first direction X and a distance from the center portion CP to another end of the nozzle Nz in the first direction X are the same, and a distance from the center portion CP to one end of the nozzle Nz in the second direction Y and a distance from the center portion CP to another end of the nozzle Nz in the second direction Y are the same.

In the present exemplary embodiment, the cross-sectional shape of the flow path of the first nozzle portion N1 and the cross-sectional shape of the flow path of the second nozzle portion N2 are different from each other. In the present exemplary embodiment, the cross-sectional shape of the flow path of the second nozzle portion N2 positioned downstream is circular. Accordingly, at the second position S2, which is where the second nozzle portion N2 is provided, a maximum value R0 and a minimum value R0 of distances between the center portion CP and edge portions of the nozzle Nz are substantially the same values, and the difference therebetween is substantially O. On the other hand, a cross-sectional shape of the flow path of the first nozzle portion N1 positioned upstream has a shape different from a circular shape and is shaped along the outer circumference of the number 8. Accordingly, at the first position S1, which is where the first nozzle portion N1 is provided, a difference between a maximum value R2 and a minimum value R1 of distances between the center portion CP and edge portions of the nozzle Nz is larger than O. In other words, in the present exemplary embodiment, each nozzle Nz is provided in the ejecting head 26 so that the difference between the maximum value R0 and the minimum value R0 of the distances, at the second position S2, between the center portion CP and the edge portions of the nozzle Nz is smaller than the difference between the maximum value R2 and the minimum value R1 of the distances, at the first position S1, between the center portion CP and the edge portions of the nozzle Nz.

Figure 6:
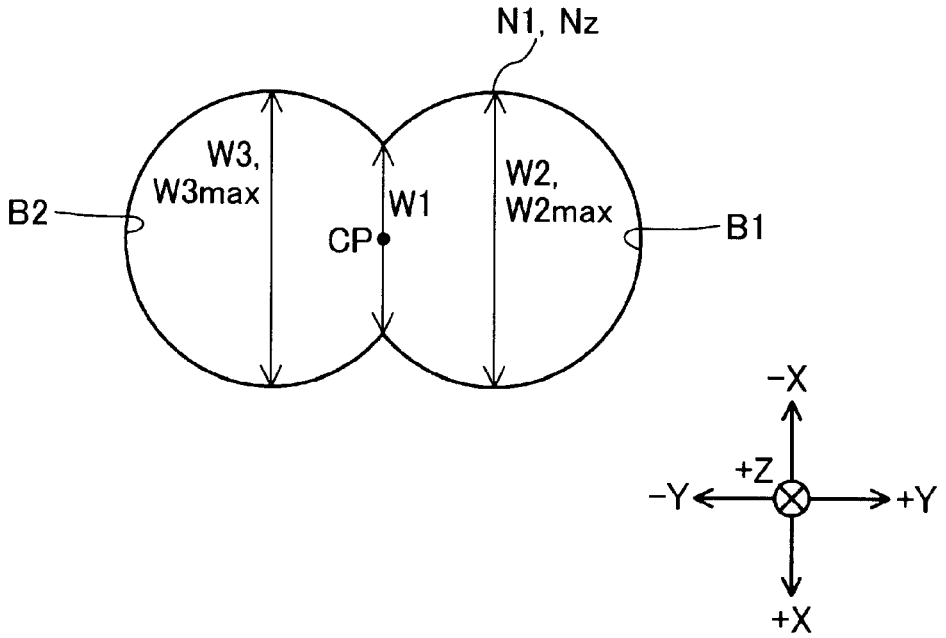
FIG. 6 is a diagram illustrating a shape of a first nozzle portion.

FIG. 6 is a diagram illustrating a shape of the first nozzle portion N1 positioned upstream. In the present exemplary embodiment, at the first position S1, which is where the first nozzle portion N1 is provided, a width W1 of the nozzle Nz in the first direction X at the position passing through the center portion CP is smaller than a maximum width W2max in the first direction X at a position on a first edge B1 side in the second direction Y with respect to the center portion CP. Furthermore, at the first position S1, the width W1 of the nozzle Nz in the first direction X at the position passing through the center portion CP is smaller than a maximum width W3max in the first direction X at a position on a second edge B2 side in the second direction Y with respect to the center portion CP. In other words, the cross-sectional shape of the flow path of the first nozzle portion N1 according to the present exemplary embodiment can be described as a shape in which two edge portions of the nozzle Nz in the X direction that oppose each other are protruded towards the center portion CP.

Furthermore, in the present exemplary embodiment, at the first position S1, which is where the first nozzle portion N1 is provided, a width W2 in the first direction gradually decreases after gradually increasing as the position of the width W2 moves from the position passing through the center portion Cp towards the first edge B1 side in the second direction Y. Furthermore, at the first position S1, which is where the first nozzle portion N1 is provided, a width W3 of the nozzle Nz in the first direction X gradually decreases after gradually increasing as the position of the width W3 moves from the position passing through the center portion CP towards the second edge B2 side in the second direction Y. More specifically, the cross section of the flow path of the first nozzle portion N1 includes, from the center portion CP towards each of the edges in the second direction Y, a portion that forms a semicircular shape. Furthermore, the cross section of the flow path of the first nozzle portion N1 according to the present exemplary embodiment can also be described as being shaped along an outer circumference of a shape formed by having two circles partially overlap each other.

Furthermore, in the present exemplary embodiment, as illustrated in FIGS. 4 and 5, the center portion CP at the first position S1, which is where the first nozzle portion N1 is provided, and the center portion CP at the second position S2, which is where the second nozzle portion N2 is provided, coincide each other. In other words, the position of the center of the first nozzle portion N1 and the position of the center of the second nozzle portion N2 coincide each other when the nozzle Nz is viewed in the ejection direction Z.

According to the ejecting head 26 of the present exemplary embodiment described above, the cross-sectional shape of the flow path of the nozzle Nz on the front end side is different from that on the rear end side, and in the present exemplary embodiment, the front end side has a circular shape and the rear end side has a different shape different from a circle. Accordingly, the residual vibration of the liquid in the nozzle Nz can be suppressed with the different shape on the rear end side, and the meniscus can be, with the circular shape on the front end side, suppressed from vibrating in various directions. Accordingly, when the ejecting head 26 is continuously driven at short periods or when the meniscus is shaken greatly to change the size of the droplet, the possibility of the droplet being deviated from the ejection direction, the droplet splitting up, change in the ejection amount, and the like can be reduced, and the liquid ejection stability can be improved. Furthermore, since the rear end side of the nozzle Nz in the present exemplary embodiment has the different shape, when the liquid is ejected, the separation between the droplet ejected through the nozzle Nz and the liquid remaining in the nozzle Nz is facilitated. Accordingly, occurrence of a satellite when the liquid is ejected can be suppressed and the print quality can be improved.

Furthermore, in the present exemplary embodiment, in the first nozzle portion N1 positioned on the rear end side of the nozzle Nz, the width of the nozzle Nz in the first direction X through where the center portion CP passes is smaller than the maximum widths W2max and W3max at both sides of the nozzle Nz in the second direction Y. Furthermore, the first nozzle portion N1 is shaped so that, from the center portion CP towards both sides in the second direction Y, the width of the nozzle Nz gradually decreases after gradually increasing. Accordingly, the droplet ejected from the nozzle Nz and the liquid remaining in the nozzle Nz can be easily separated from each other and occurrence of a satellite can be suppressed.

Furthermore, in the present exemplary embodiment, at the second position S2, which is where the second nozzle portion N2 is positioned, the difference between the maximum value R0 and the minimum value R0 of the distances between the center portion CP and the edge portions of the nozzle Nz is 0. In other words, since the cross-sectional shape of the flow path of the second nozzle portion N2 is a perfect circle, the meniscus can be formed in a stable manner.

Furthermore, in the present exemplary embodiment, the center of the first nozzle portion N1 positioned at the rear end side of the nozzle Nz, and the center of the second nozzle portion N2 positioned at the front end side coincide each other. Accordingly, since the liquid flows smoothly inside the nozzle Nz, the droplet can be ejected in a satisfactory manner.

Note that in the present exemplary embodiment, a flow path resistance of the first nozzle portion N1 is, desirably, equivalent to or larger than a flow path resistance of the second nozzle portion N2. By setting the flow path resistance of the first nozzle portion N1 large, the residual vibration of the liquid inside the nozzle Nz can be suppressed effectively. In order to set the flow path resistance of the first nozzle portion N1 larger than the flow path resistance of the second nozzle portion N2, for example, a length of the edge portion of the second nozzle portion N2, which is disposed at the second position S2, in the ejection direction Z is made smaller than a length of the edge portion of the first nozzle portion N1, which is disposed at the first position S1, in the ejection direction Z. Alternatively, a length of the edge portion of the second nozzle portion N2, which is disposed at the second position S2, in the circumferential direction is made smaller than a length of the edge portion of the first nozzle portion N1, which is disposed at the first position S1, in the circumferential direction.

Furthermore, in the present exemplary embodiment, an inertance of the first nozzle portion N1 is, desirably, equivalent to or smaller than an inertance of the second nozzle portion N2. By setting the inertance of the first nozzle portion N1 small, a decrease in the ejection efficiency caused by having the first nozzle portion N1 have the different shape can be suppressed. In order to set the inertance of the first nozzle portion N1 smaller than the inertance of the second nozzle portion N2, for example, the cross-sectional area of the flow path of the second nozzle portion N2 disposed at the second position S2 is made smaller than the cross-sectional area of the flow path of the first nozzle portion N1 disposed at the first position S1. Alternatively, the inertance of the first nozzle portion N1 can also be set smaller than the inertance of the second nozzle portion N2 by making the length of the edge portion of the second nozzle portion N2, which is disposed at the second position S2, in the ejection direction Z larger than the length of the edge portion of the first nozzle portion N1, which is disposed at the first position S1, in the ejection direction Z.

Second Exemplary Embodiment

Figure 7:
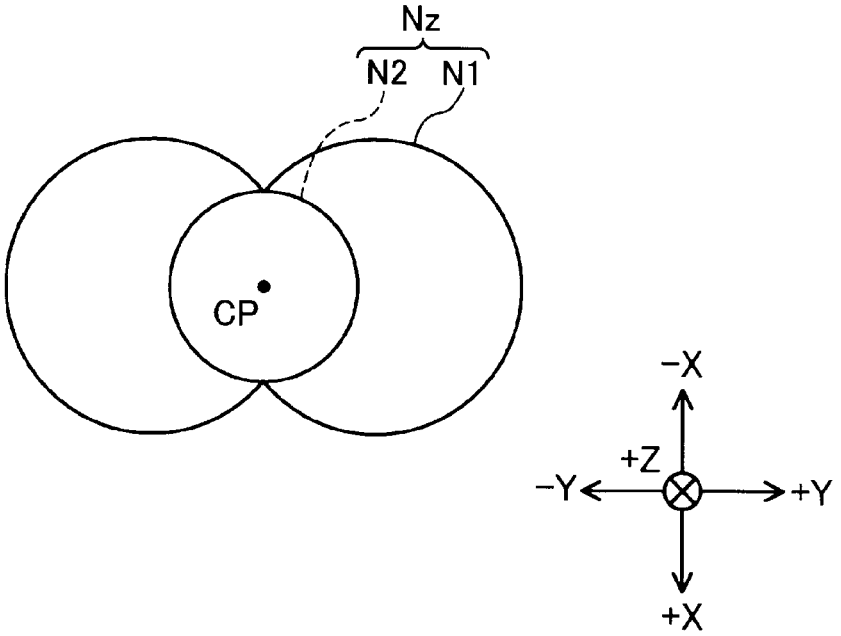
FIG. 7 is a diagram illustrating a shape of the nozzle according to a second exemplary embodiment.

FIG. 7 is a diagram illustrating a shape of the nozzle Nz according to a second exemplary embodiment. In the example illustrated in FIG. 4, the maximum width of the second nozzle portion N2 is larger than a minimum width of the first nozzle portion N1. On the other hand, in the second exemplary embodiment, as illustrated in FIG. 7, the maximum width of the second nozzle portion N2 is substantially the same as the minimum width of the first nozzle portion N1. Furthermore, in the other exemplary embodiments, the maximum width of the second nozzle portion N2 may be smaller than the minimum width of the first nozzle portion N1.

Third Exemplary Embodiment

Figure 8:
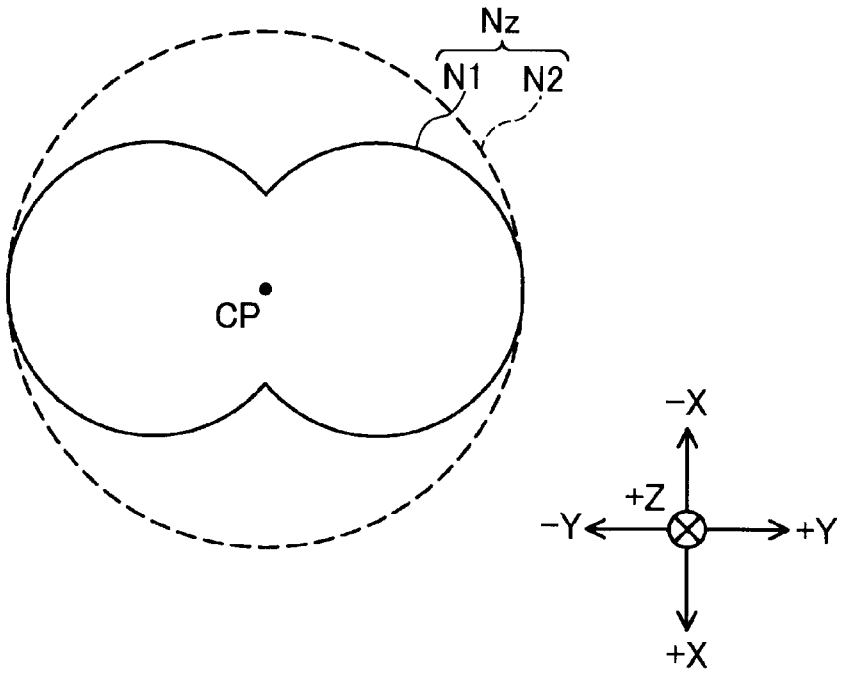
FIG. 8 is a diagram illustrating a shape of the nozzle according to a third exemplary embodiment.

FIG. 8 is a diagram illustrating a shape of the nozzle Nz according to a third exemplary embodiment. In the example illustrated in FIG. 7, the maximum width of the second nozzle portion N2 is substantially the same as the minimum width of the first nozzle portion N1. On the other hand, in the third exemplary embodiment, as illustrated in FIG. 8, the maximum width of the second nozzle portion N2 is substantially the same as the maximum width of the first nozzle portion N1. Furthermore, in the other exemplary embodiments, the maximum width of the second nozzle portion N2 may be larger than the maximum width of the first nozzle portion N1.

Fourth Exemplary Embodiment

Figure 9:
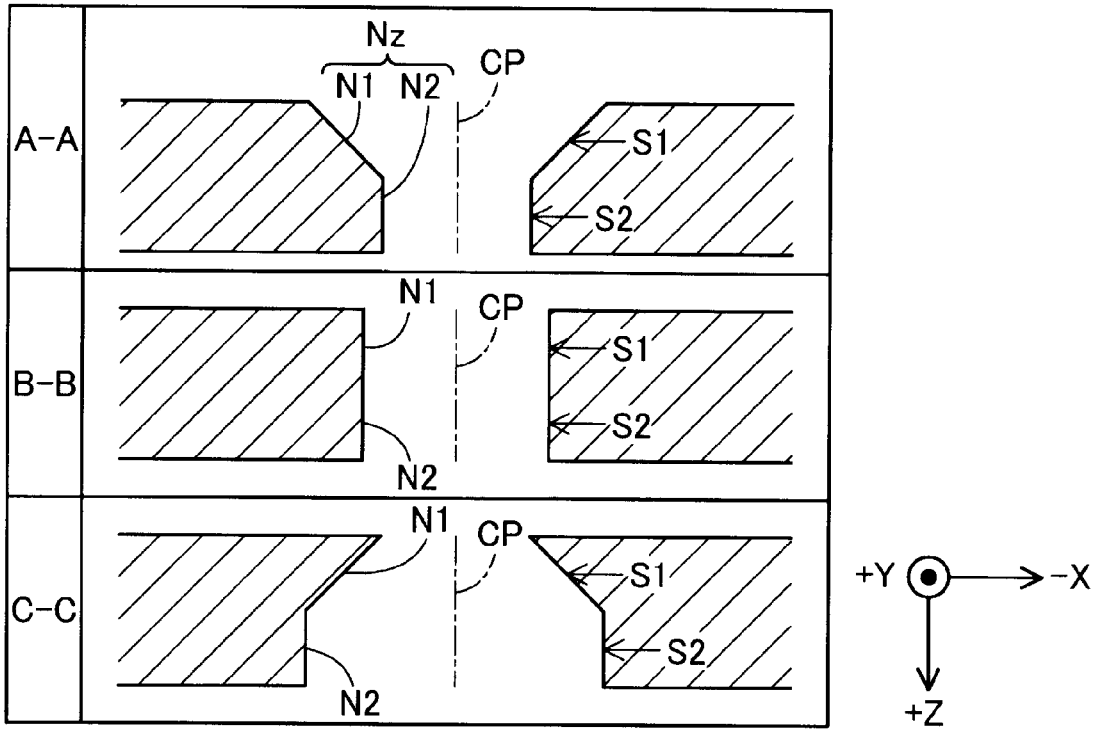
FIG. 9 is a diagram illustrating cross-sectional structures of a nozzle according to a fourth exemplary embodiment at various portions.

FIG. 9 is a diagram illustrating cross-sectional structures of a nozzle Nz according to a fourth exemplary embodiment at various portions. The cross sections illustrated in FIG. 9 illustrate the cross sections at various positions illustrated in FIG. 5. In the fourth exemplary embodiment, the width of the nozzle Nz in the first direction X at positions passing through at least the center portion CP changes as the position of the width moves from the first position S1 towards the second position S2 in the ejection direction Z. In other words, in the fourth exemplary embodiment, the first nozzle portion N1 and the second nozzle portion N2 are connected to each other so that a step is not created in the boundary therebetween. In the present exemplary embodiment, the step between the first nozzle portion N1 and the second nozzle portion N2 is eliminated by having the edge portion of the first nozzle portion N1 be an inclined surface. With such a configuration, air bubbles can be suppressed from accumulating between the first nozzle portion N1 and the second nozzle portion N2, and the discharge of the air bubbles from the nozzle Nz can be facilitated. Note that the inclined surface does not necessarily have to be formed up to the end portion in the −Z direction. In other words, the end portion in the −Z direction may be provided so that the width of the nozzle Nz in the first direction X does not change.

Fifth Exemplary Embodiment

Figure 10:
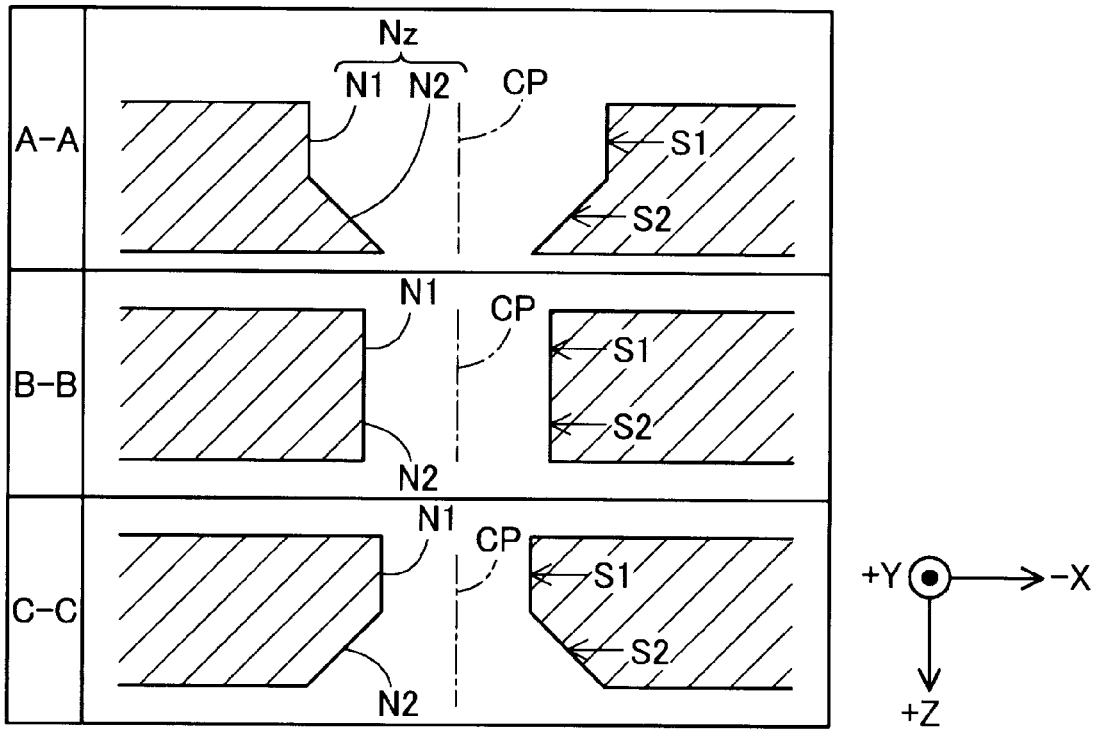
FIG. 10 is a diagram illustrating cross-sectional structures of a nozzle according to a fifth exemplary embodiment at various portions.

FIG. 10 is a diagram illustrating cross-sectional structures of a nozzle Nz according to a fifth exemplary embodiment at various portions. The cross sections illustrated in FIG. 10 illustrate the cross sections at various positions illustrated in FIG. 5. Similar to the fourth exemplary embodiment, in the fifth exemplary embodiment, the first nozzle portion N1 and the second nozzle portion N2 are connected to each other so that a step is not created in the boundary therebetween. In the present exemplary embodiment, the step between the first nozzle portion N1 and the second nozzle portion N2 is eliminated by having the edge portion of the second nozzle portion N2 be an inclined surface. With such a configuration as well, air bubbles can be suppressed from accumulating between the first nozzle portion N1 and the second nozzle portion N2, and the discharge of the air bubbles from the nozzle Nz can be facilitated. Note that the inclined surface does not necessarily have to be formed down to the end portion in the +Z direction. In other words, the end portion in the +Z direction may be provided so that the width of the nozzle Nz in the first direction X does not change.

Other Exemplary Embodiments

The shapes of the nozzles Nz in each of the exemplary embodiments described above are all illustrated as examples. The shape of the nozzle Nz is not limited to that in each exemplary embodiment described above as long as each nozzle Nz is provided in the ejecting head 26 so that the difference between the maximum value R0 and the minimum value R0 of the distances in the nozzle Nz, at the second position S2, between the center portion CP and the edge portions of the nozzle Nz is smaller than the difference between the maximum value R2 and the minimum value R1 of the distances, at the first position S1, between the center portion CP and the edge portions of the nozzle Nz. For example, the shape of each of the first nozzle portion N1 and the second nozzle portion N2 may be an ellipse. Furthermore, the first nozzle portion N1 may be an ellipse that has an ellipticity that is larger than that of the second nozzle portion N2. Other than the above, for example, the edge portion of the first nozzle portion N1 may be protruded inwards at one or three or more portions.

In the exemplary embodiments described above, the first direction is a direction that is the same as the X direction, which is the nozzle row direction, and second direction is a direction that is the same as the Y direction, which is the main scanning direction of the ejecting head 26. However, the first direction and the second direction are not limited to the above directions. The first direction may be any specific direction that intersects the ejection direction, and the second direction may be any specific direction that intersects the ejection direction and the first direction.

The structure of the ejecting head 26 in the exemplary embodiments described above is illustrated as an example, and the structure of the ejecting head 26 is not limited to that of the exemplary embodiments described above. For example, in the exemplary embodiments described above, while two nozzle rows are provided in the ejecting head 26, the number of rows may be one, or three or more. Furthermore, the ejecting head 26 in the exemplary embodiments described above may be configured to not include elements that are involved in the circulation of the ink, such as the second individual flow paths 72, the second common flow path 65, and the circulation mechanism.

In the exemplary embodiments described above, the center portion CP of the first nozzle portion N1 and the center portion CP of the second nozzle portion N2 coincide each other. However, the center portions CP may be shifted from each other.

Other Configurations

The present disclosure is not limited to the embodiments described above and can be implemented in various configurations that do not depart from the scope of the disclosure. For example, the technical features described below corresponding to the technical features of the embodiments can be appropriately replaced or combined in order to overcome a portion or all of the issues described above or to achieve a portion or all of the effects described above. Furthermore, the technical features that are not described in the present specification as an essential feature may be omitted as appropriate.

(1) According to a first configuration of the present disclosure, an ejecting head is provided. The ejecting head includes an energy generating element that generates energy that ejects a liquid, an energy generating chamber that contains the energy generating element, and a nozzle that is in communication with the energy generating chamber and that ejects the liquid in an ejection direction with the energy generated by the energy generating element. When a first position is a specific position in the nozzle in the ejection direction, a second position is a specific position in the nozzle, which is downstream the first position in the ejection direction, a first direction is a specific direction intersecting the ejection direction, a second direction is a specific direction intersecting the ejection direction and the first direction, and a center portion is a position that corresponds to a center of the nozzle in the first direction and to that in the second direction at positions in the ejection direction including the first position and the second position, the nozzle is provided so that a difference between a maximum value and a minimum value of distances, at the second position, between the center portion and edge portions of the nozzle is smaller than a difference between a maximum value and a minimum value of distances, at the first position, between the center portion and edge portions of the nozzle. With such a configuration, a meniscus can be formed in the nozzle in a stable manner and occurrence of a satellite when the liquid is ejected can be suppressed.

(2) In the ejecting head described above, at the first position, a width of the nozzle in the first direction at a position passing through the center portion may be smaller than a maximum width in the first direction at a position on a first edge side in the second direction with respect to the center portion, and the nozzle may be provided so that, at the first position, a width of the nozzle in the first direction at a position passing through the center portion is smaller than a maximum width in the first direction at a position on a second edge side in the second direction with respect to the center portion. With such a configuration, occurrence of a satellite when the liquid is ejected can be suppressed.

(3) In the ejecting head described above, the nozzle may be provided so that at the first position, a width of the nozzle in the first direction gradually decreases after gradually increasing as a position of the width moves from the position passing through the center portion towards the first edge side in the second direction, and at the first position, a width of the nozzle in the first direction gradually decreases after gradually increasing as a position of the width moves from the position passing through the center portion towards the second edge side in the second direction. With such a configuration, occurrence of a satellite when the liquid is ejected can be suppressed.

(4) In the ejecting head describe above, a difference between a maximum value and a minimum value of distances between the center portion and edge portions of the nozzle at the second position may be 0. With such a configuration, a meniscus can be formed in the nozzle in a stable manner.

(5) In the ejecting head described above, the center portion at the first position and the center portion at the second position may coincide each other. With such a configuration, the liquid can be ejected in a satisfactory manner.

(6) In the ejecting head described above, a width of the nozzle in the first direction at a position passing through the center portion may gradually change as a position in the ejection direction moves from the first position towards the second position. With such a configuration, an air discharging property of the nozzle can be improved.

(7) In the ejecting head described above, the nozzle may be provided so that a length of an edge portion of the nozzle at the second position and in the ejection direction is smaller than a length of an edge portion of the nozzle at the first position and in the ejection direction. With such a configuration, since the flow path resistance of the nozzle at the first position becomes large, the vibration in the liquid inside the nozzle can be suppressed from remaining.

(8) In the ejecting head described above, the nozzle may be provided so that a length of an edge portion of the nozzle at the second position and in a circumferential direction is smaller than a length of an edge portion of the nozzle at the first position and in the circumferential direction. With such a configuration as well, since the flow path resistance of the nozzle at the first position becomes large, the vibration in the liquid inside the nozzle can be suppressed from remaining.

(9) In the ejecting head described above, the nozzle may be provided so that a cross-sectional area of a flow path of the nozzle at the second position is smaller than a cross-sectional area of the flow path of the nozzle at the first position. With such a configuration, since the inertance of the nozzle at the first position can be made small, a decrease in the liquid ejection efficiency can be suppressed.

The present disclosure is not limited to the configurations of the ejecting head described above, and can be implemented in various configurations such as a liquid ejecting apparatus including an ejecting head and a liquid ejecting system.

What is claimed is:

1. An ejecting head comprising: an energy generating element that generates energy that ejects a liquid;

an energy generating chamber that contains the energy generating element; and a nozzle that is in communication with the energy generating chamber and that ejects the liquid in an ejection direction with the energy generated by the energy generating element, wherein when a first position is a specific position in the nozzle in the ejection direction, when a second position is a specific position in the nozzle, which is downstream the first position in the ejection direction, when a first direction is a specific direction intersecting the ejection direction, when a second direction is a specific direction intersecting the ejection direction and the first direction, and when a center portion is a position that corresponds to a center of the nozzle in the first direction and to that in the second direction at positions in the ejection direction including the first position and the second position, the nozzle is provided so that a difference between a maximum value and a minimum value of distances, at the second position, between the center portion and edge portions of the nozzle is smaller than a difference between a maximum value and a minimum value of distances, at the first position, between the center portion and edge portions of the nozzle.

2. The ejecting head according to claim 1, wherein at the first position, a width of the nozzle in the first direction at a position passing through the center portion is smaller than a maximum width in the first direction at a position on a first edge side in the second direction with respect to the center portion, and the nozzle is provided so that, at the first position, a width of the nozzle in the first direction at a position passing through the center portion is smaller than a maximum width in the first direction at a position on a second edge side in the second direction with respect to the center portion.

3. The ejecting head according to claim 2, wherein the nozzle is provided so that at the first position, a width of the nozzle in the first direction gradually decreases after gradually increasing as a position of the width moves from the position passing through the center portion towards the first edge side in the second direction, and at the first position, a width of the nozzle in the first direction gradually decreases after gradually increasing as a position of the width moves from the position passing through the center portion towards the second edge side in the second direction.

4. The ejecting head according to claim 1, wherein a difference between a maximum value and a minimum value of distances between the center portion and edge portions of the nozzle at the second position is 0.

5. The ejecting head according to claim 1, wherein the center portion at the first position and the center portion at the second position coincide each other.

6. The ejecting head according to claim 1, wherein a width of the nozzle in the first direction at a position passing through the center portion gradually changes as a position in the ejection direction moves from the first position towards the second position.

7. The ejecting head according to claim 1, wherein the nozzle is provided so that a length of an edge portion of the nozzle at the second position and in the ejection direction is smaller than a length of an edge portion of the nozzle at the first position and in the ejection direction.

8. The ejecting head according to claim 1, wherein the nozzle is provided so that a length of an edge portion of the nozzle at the second position and in a circumferential direction is smaller than a length of an edge portion of the nozzle at the first position and in the circumferential direction.

9. The ejecting head according to claim 1, wherein the nozzle is provided so that a cross-sectional area of a flow path of the nozzle at the second position is smaller than a cross-sectional area of the flow path of the nozzle at the first position.

* * * * *